US008967050B2

(12) United States Patent
Han

(10) Patent No.: US 8,967,050 B2
(45) Date of Patent: Mar. 3, 2015

(54) TRAIN PLATFORM SAFETY DEVICE

(75) Inventor: Seong-Moo Han, Yeosu-si (KR)

(73) Assignees: SKD Hi-Tec Co., Ltd., Kwangyang-si (KR); Seong-Moo Han, Yeosu-si (KR)

( * ) Notice: Subject to any disclaimer, the term of this patent is extended or adjusted under 35 U.S.C. 154(b) by 22 days.

(21) Appl. No.: 14/002,167

(22) PCT Filed: Dec. 28, 2011

(86) PCT No.: PCT/KR2011/010252
§ 371 (c)(1),
(2), (4) Date: Nov. 5, 2013

(87) PCT Pub. No.: WO2012/118273
PCT Pub. Date: Sep. 7, 2012

(65) Prior Publication Data

US 2014/0047994 A1 Feb. 20, 2014

(30) Foreign Application Priority Data

Mar. 1, 2011 (KR) ..... 10-2011-0018255
Dec. 9, 2011 (KR) ..... 10-2011-0131588

(51) Int. Cl.
*B61B 1/00* (2006.01)
*B61B 1/02* (2006.01)
*E01F 13/02* (2006.01)
*E01F 13/04* (2006.01)

(52) U.S. Cl.
CPC ..... *B61B 1/02* (2013.01); *E01F 13/028* (2013.01); *E01F 13/048* (2013.01)
USPC ..... 104/30; 104/27

(58) Field of Classification Search
USPC ..... 104/27–30; 105/331–333, 339, 341, 105/343; 404/6, 9
See application file for complete search history.

(56) References Cited

U.S. PATENT DOCUMENTS

| | | | | | |
|---|---|---|---|---|---|
| 4,082,042 | A * | 4/1978 | Barry | 104/18 |
| 5,253,589 | A * | 10/1993 | Kawanishi et al. | 104/28 |
| 5,295,441 | A * | 3/1994 | Kawanishi et al. | 104/28 |
| 6,227,523 | B1 * | 5/2001 | Haberlen | 256/59 |
| 6,414,454 | B1 * | 7/2002 | Lhotak et al. | 318/266 |
| 7,143,658 | B2 * | 12/2006 | Schubert | 73/862.632 |
| 7,328,662 | B2 * | 2/2008 | Kasai et al. | 105/429 |
| 7,721,653 | B1 * | 5/2010 | Burgess | 104/28 |
| 8,742,925 | B2 * | 6/2014 | Vacher et al. | 340/540 |

(Continued)

FOREIGN PATENT DOCUMENTS

| | | | |
|---|---|---|---|
| JP | 2004268634 | A | 9/2004 |
| JP | 2004322823 | A | 11/2004 |
| KR | 100601112 | B1 | 7/2006 |

*Primary Examiner* — Jason C Smith
(74) *Attorney, Agent, or Firm* — The Webb Law Firm

(57) ABSTRACT

Disclosed herein is a train platform safety device. The train platform safety device is installed at a position corresponding to a safety line on a subway or railway platform and is configured such that wire ropes are moved upwards or downwards depending on conditions in which a train approaches or departs from the platform, thus preventing a passenger from intentionally or unintentionally falling onto the train track. Particularly, the distances that the wire ropes move upwards or downwards are determined by rotating a rotating unit including rotating members having different diameters, whereby the wire ropes overlap each other or spread from each other. In this way, the wire ropes allow or block access of passengers depending on conditions in which a train approaches or departs from the platform, thus fundamentally preventing a safety accident.

8 Claims, 8 Drawing Sheets

(56) References Cited

U.S. PATENT DOCUMENTS

| | | | | |
|---|---|---|---|---|
| 2002/0003065 | A1* | 1/2002 | Tonna et al. | 187/324 |
| 2006/0140718 | A1* | 6/2006 | Lamore | 404/6 |
| 2006/0147261 | A1* | 7/2006 | Wong | 404/6 |
| 2006/0182495 | A1* | 8/2006 | Bergendahl et al. | 404/6 |
| 2006/0191749 | A1* | 8/2006 | Sasaki et al. | 187/391 |
| 2006/0243535 | A1* | 11/2006 | Kinoshita et al. | 187/319 |
| 2007/0258761 | A1* | 11/2007 | Orner et al. | 404/6 |
| 2007/0295564 | A1* | 12/2007 | Someya | 187/319 |
| 2008/0098924 | A1* | 5/2008 | Han | 104/31 |
| 2009/0003932 | A1* | 1/2009 | Neusch | 404/6 |
| 2009/0165665 | A1* | 7/2009 | Gunes | 104/30 |
| 2010/0180790 | A1* | 7/2010 | Losito | 104/30 |
| 2014/0047994 | A1* | 2/2014 | Han | 104/30 |

* cited by examiner

TRAIN PLATFORM SAFETY DEVICE

CROSS-REFERENCE TO RELATED APPLICATIONS

This application is the United States national phase of International Application No. PCT/KR2011/010252 filed Dec. 28, 2011, and claims priority to Korean Patent Application Nos. 10-2011-0018255, filed Mar. 1, 2011, and 10-2011-0131588, filed Dec. 9, 2011 the disclosures of which are hereby incorporated by reference in their entirety.

TECHNICAL FIELD

The present invention relates, in general, to train platform safety devices and, more particularly, to a train platform safety device (referred to as a rope screen door, "RSD") which is configured such that, as rotating members having different diameters are rotated, distances that a plurality of blocks to which wire ropes are connected are moved upwards or downwards are determined so that the wire ropes overlap each other or spread from each other, thus allowing or blocking access of passengers depending on conditions in which a train approaches or departs from the platform.

BACKGROUND ART

Generally, subway or railway platforms are open towards train tracks to allow passengers to board trains. Therefore, accidents of passengers falling onto train tracks or colliding with trains that are entering the platforms frequently occur. In an effort to overcome the above problems, a yellow safety line is marked on a platform to recommend passengers to stand behind while waiting for a train.

However, the yellow safety line merely functions to attract attention for safety such that passengers stand back behind the safety line, but the line itself cannot actually function to block a passenger from falling onto the train track or colliding with a train.

Therefore, recently, screen doors are installed between platforms and train tracks to prevent passengers from falling or collision accidents. In such a screen door, a stationary wall and a movable door are installed between a platform and a train track, and the movable door is opened in conjunction with a door of a train only when the train stops in the platform.

However, the conventional screen door is disadvantageous in that several tens of movable doors corresponding to doors of a train are required, thus increasing the production cost and initial installation cost. Furthermore, the screen door is operated depending on a position at which the train stops. If the position at which the train stops does not correspond to that of the screen door, the screen door is not operated. As a result, the time it takes for passengers to exit and enter a train is increased, thus inconveniencing the passengers.

Particularly, in emergency situations, for example, when fire accidents occur in subways, if power is interrupted, the screen door cannot be operated. In this case, the exits through which passengers can escape from the train are blocked, thus resulting in a tragic disaster.

Furthermore, the screen door is controlled by a train and an ATO (automatic train operating) system. Only some subway stations are equipped with such ATO systems. Therefore, the screen door cannot be used in an existing subway system which has no ATO system. Eventually, there are problems in that usage efficiency and utilization range of the screen door are very limited.

To solve the problems of the conventional technique, a train platform safety device was proposed in Korean Patent Registration No. 0601112 (Jul. 19, 2006) which was filed by the inventor of the present invention.

However, in this conventional technique, the number of drive units that corresponds to the number of blocks on which wire ropes are arranged is required. As a result, excessive large volume and space are required, so that usage efficiency is limited.

Furthermore, because the wire ropes must be moved upwards or downwards at the same time depending on a position at which a train stops, it is very difficult to precisely control the safety device in consideration of the lengths of the wire ropes and stroke distances of cylinders, thus making passengers uneasy.

Particularly, a large number of drive units and related elements are required in response to the number of blocks on which the wire ropes are arranged, thus increasing the production and installation costs.

Moreover, given the height to which the wire ropes for blocking access of passengers move upwards or downwards, the height of the train platform safety device is largely increased, thus also increasing the entire size of the train platform safety device.

In addition, because the structure of the conventional train platform safety device is complex, it frequently malfunctions, thus making maintenance difficult.

DISCLOSURE

Technical Problem

Accordingly, the present invention has been made keeping in mind the above problems occurring in the prior art, and an object of the present invention is to provide a train platform safety device which is configured such that a single drive unit rotates a rotating unit including a plurality of rotating members having different diameters so that a plurality of blocks to which wire ropes are connected are moved upwards or downwards, whereby the wire ropes overlap each other or spread from each other, thus allowing or blocking access of passengers.

Technical Solution

In order to accomplish the above object, the present invention provides a train platform safety device, including: a plurality of wire rope lift units (100) installed at selected locations between an inlet of a platform through which a train enters the platform and an outlet of the platform, the wire rope lift units (100) moving wire ropes (200) upwards or downwards; the wire ropes (200) oriented horizontally, the wire ropes (200) connecting the wire rope lift units (100) to each other; and a plurality of wire rope sagging prevention units (300) disposed at positions spaced apart from each other at predetermined intervals between the wire rope lift units (100) so as to prevent the wire ropes (200) from sagging and guide the wire ropes (200) so that the wire ropes (200) smoothly move upwards or downwards, wherein each of the wire rope lift units (100) comprises: a body (110) vertically installed on the ground; a guide (120) vertically provided at a predetermined position of the body; a plurality of blocks (130) installed so as to be movable upwards or downwards along the guide (120), with the wire ropes (200) connected to predetermined portions of the blocks (130) at positions spaced apart from each other at regular intervals in the vertical direction; a rotating unit (140) rotatably provided at a predetermined position on an upper end or lower end of the body, the rotating unit comprising a plurality of rotating members having different diameters, the rotating members being respectively connected to the blocks, wherein the rotating members are rotated or reversely rotated at a same time so as to determine distances that the blocks are moved upwards or downwards such that the wire ropes (200) overlap each other or spread from each other; and a drive unit (150) installed at a predetermined position in the body (110), the driving unit (150) rotating the rotating unit (140). Wherein each rotating member of the rotating unit (140) comprises a gear, pulley or sprocket.

Preferably, guide rails (121) may be provided on opposite side surfaces of the guide (120) in a longitudinal direction of the guide (120), and a plurality of guide rollers (131) may be provided on a surface of each of the blocks (130), the guide rollers (131) making contact with the corresponding guide rails (121) and rolling along the guide rails (121).

Furthermore, a connection means (141) may be wound around each rotating member of the rotating unit (140) and connected to a predetermined portion of the corresponding block (130).

The drive unit (150) may include: a cylinder installed at a predetermined position in the body (110); a drive pulley (151) connected to an end of the rotating unit (140); an interlocking pulley (153) rotatably provided on a rod of the cylinder; and a connector (152) fastened to a portion of the body (110), the connector (152) being provided around the interlocking pulley (153) and connected to the drive pulley (151).

The cylinder may have rods on first and second ends thereof, the interlocking pulley (153) may be provided on the rod disposed on the first end of the cylinder, and a weight unit (160) may be provided on the rod disposed on the second end of the cylinder.

The cylinder may have rods on first and second ends thereof, the interlocking pulley (153) may be provided on the rod disposed on the first end of the cylinder, and a connection member (171) may be provided on the rod disposed on the second end of the cylinder, the connection member (171) being connected at a lower end thereof to a rod of an auxiliary cylinder (170) installed on a bottom of the body (110).

The drive unit (150) may include: a drive motor (150*a*) installed at a predetermined position in the body (150); a drive sprocket (151*a*) connected to an end of the rotating unit (140); a rotating sprocket (152*a*) provided on a rotating shaft of the drive motor (150*a*); and a chain (153*a*) connecting the drive sprocket (151*a*) to the rotating sprocket (152*a*).

A plurality of support rollers (132) may be provided on a surface of each of the blocks (130), each of the wire ropes (200) may be wrapped over the corresponding support rollers (132), opposite ends of the wire rope are connected to each other, and a tension adjustment spring (133) may be provided on a junction between the opposite ends of the wire rope (200).

Advantageous Effects

A train platform safety device according to the present invention is installed at a position corresponding to a safety line on a subway or railway platform and is configured such that wire ropes are moved upwards or downwards depending on conditions in which a train approaches or departs from the platform, thus preventing a passenger from intentionally or unintentionally falling onto a trail track.

Particularly, the distances that the wire ropes move upwards or downwards are determined by rotating a rotating unit including rotating members having different diameters, whereby the wire ropes overlap each other or spread from each other. In this way, the wire ropes allow or block access of passengers depending on conditions in which a train approaches or departs from the platform, thus fundamentally preventing safety accidents.

Furthermore, in the present invention, a single drive unit moves blocks connected to the wire ropes upwards or downwards so that the volume of the device is reduced, thus increasing not only installation efficiency but also usage efficiency.

In addition, because the single drive unit can reliably move the wire ropes upwards or downwards, the device can be prevented from making passengers uneasy.

Further, the present invention does not require a plurality of drive units and related elements, thus reducing the size of the device and the production and installation costs.

The structure of the present invention is simple so that the device can be prevented from frequently malfunctioning. Thus, maintenance and repair can be facilitated, and operational efficiency can be enhanced.

The present invention not only can be used in a platform for trains but can also be used in industrial sites with the purpose of preventing passengers or workers from having accidents.

BEST MODE

Hereinafter, the construction of the present invention will be described in detail with reference to the attached drawings.

Figure 1:
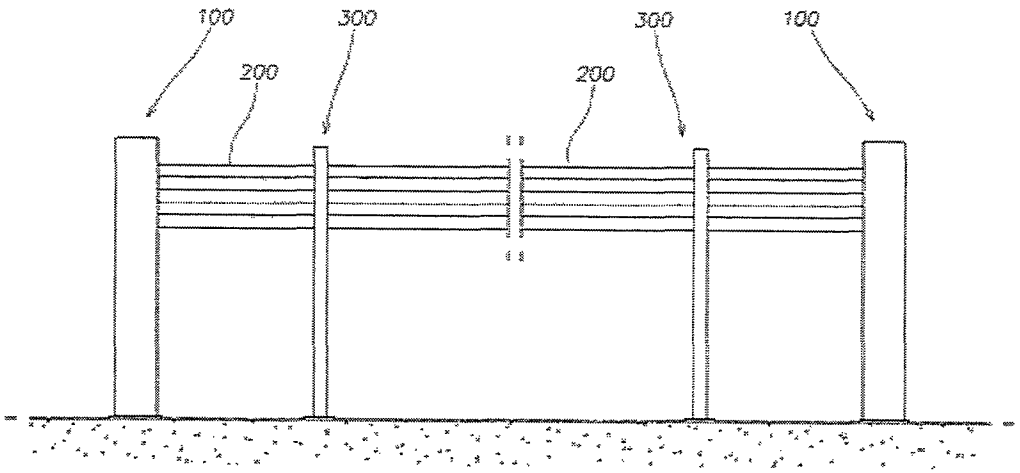
FIG. 1 is a front view showing the construction of a typical train platform safety device.
Figure 2:
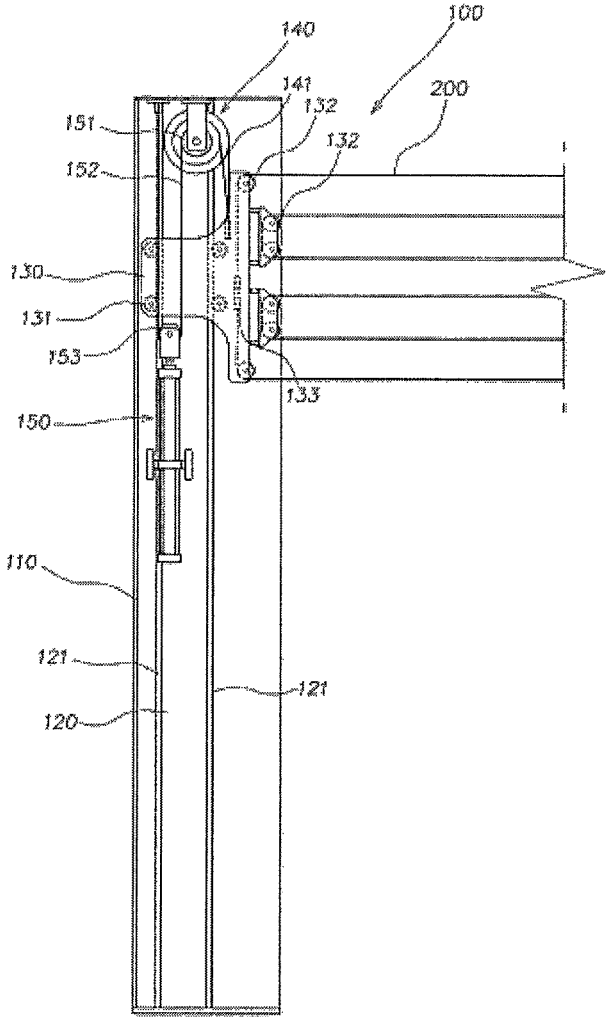
FIG. 2 is a front view illustrating the construction of a train platform safety device, according to the present invention.
Figure 3:
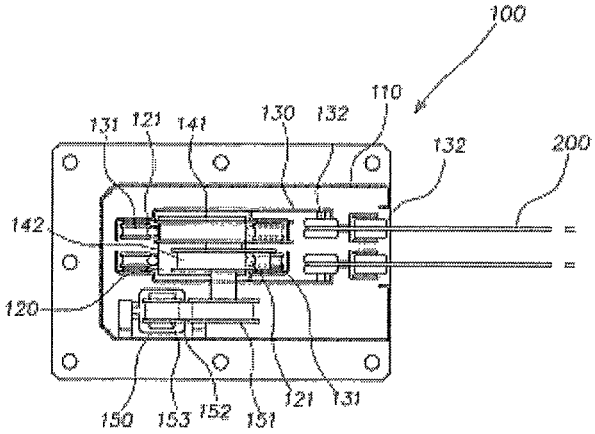
FIG. 3 is a plan view illustrating the construction of the train platform safety device, according to the present invention.
Figure 4:
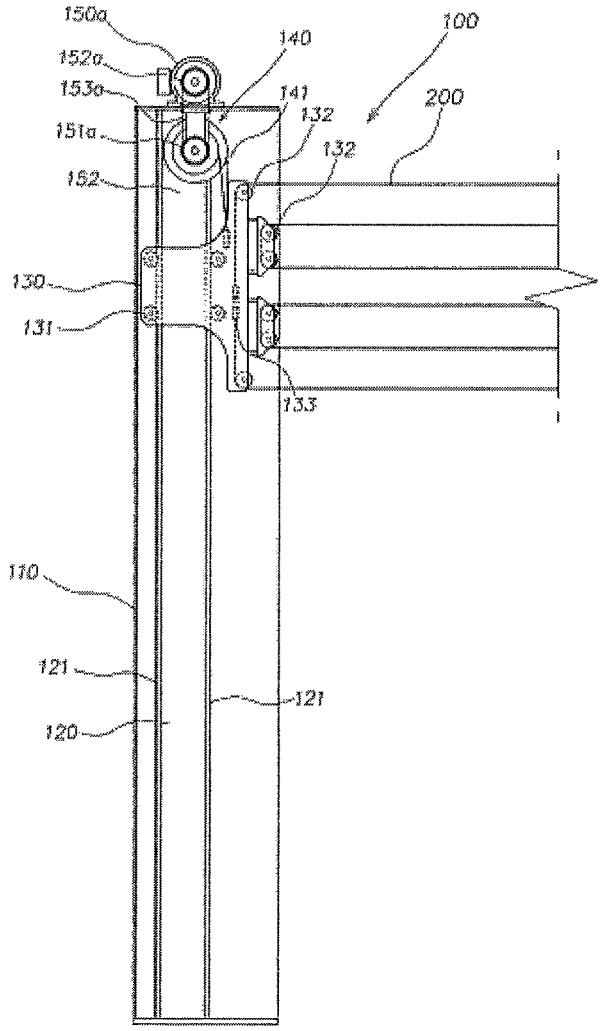
FIGS. 4 through 6 are front views showing another embodiment of the train platform safety device according to the present invention.
Figure 5:
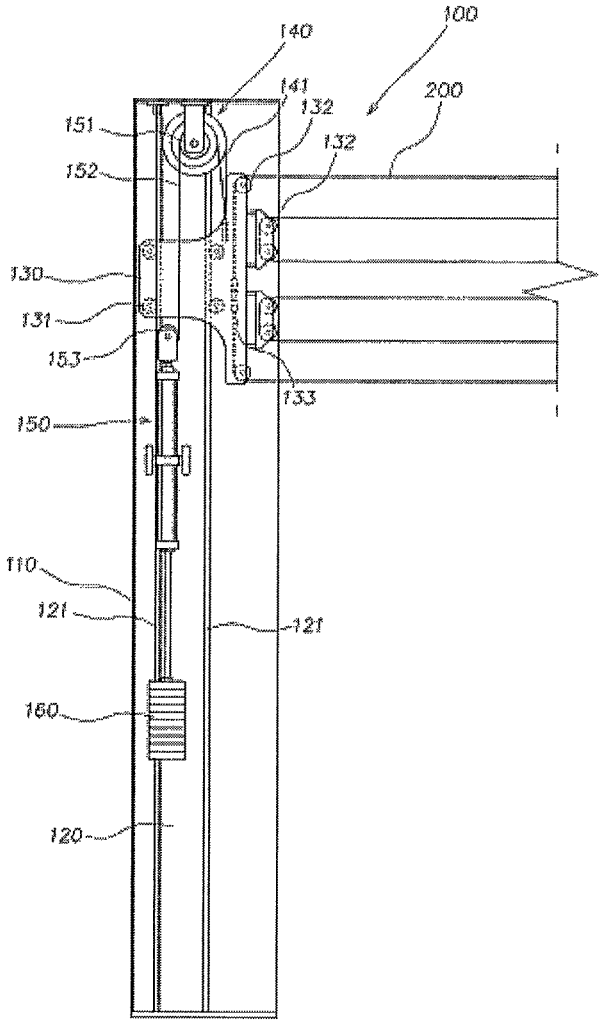
Figure 6:
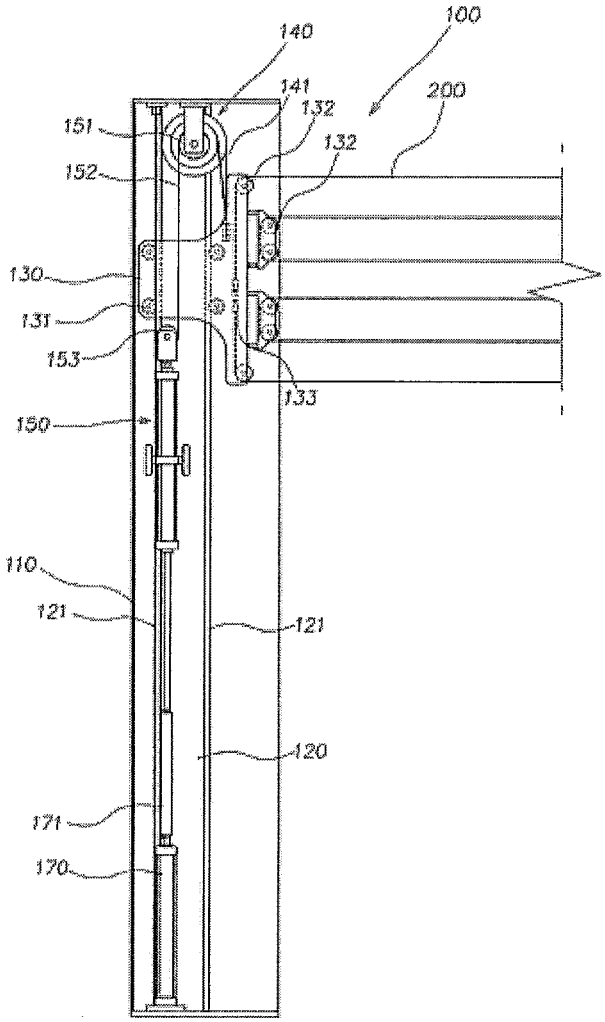
Figure 7:
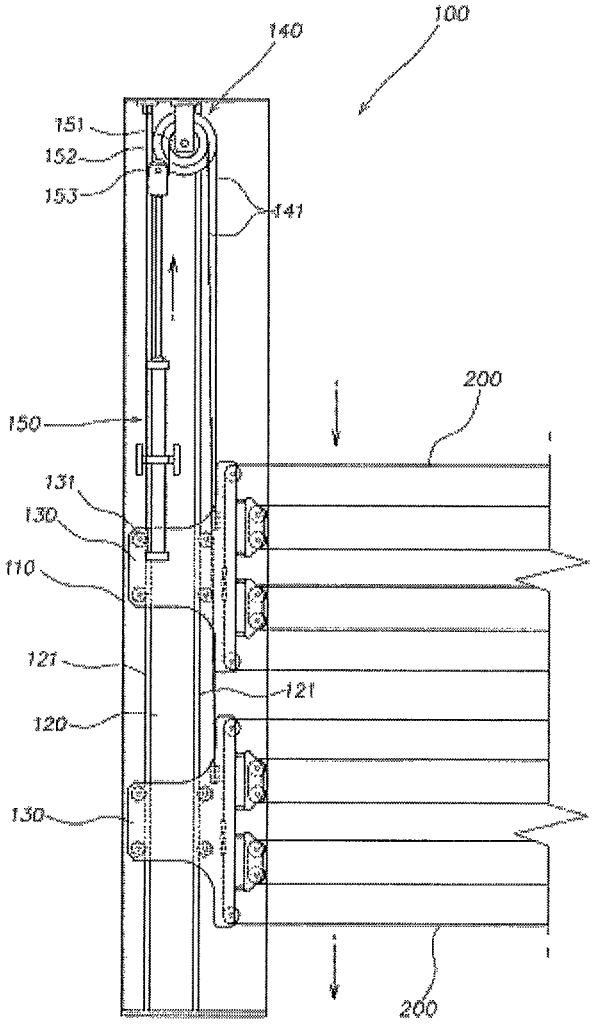
FIGS. 7 and 8 are front views illustrating the operation of the train platform safety device according to the present invention.
Figure 8:
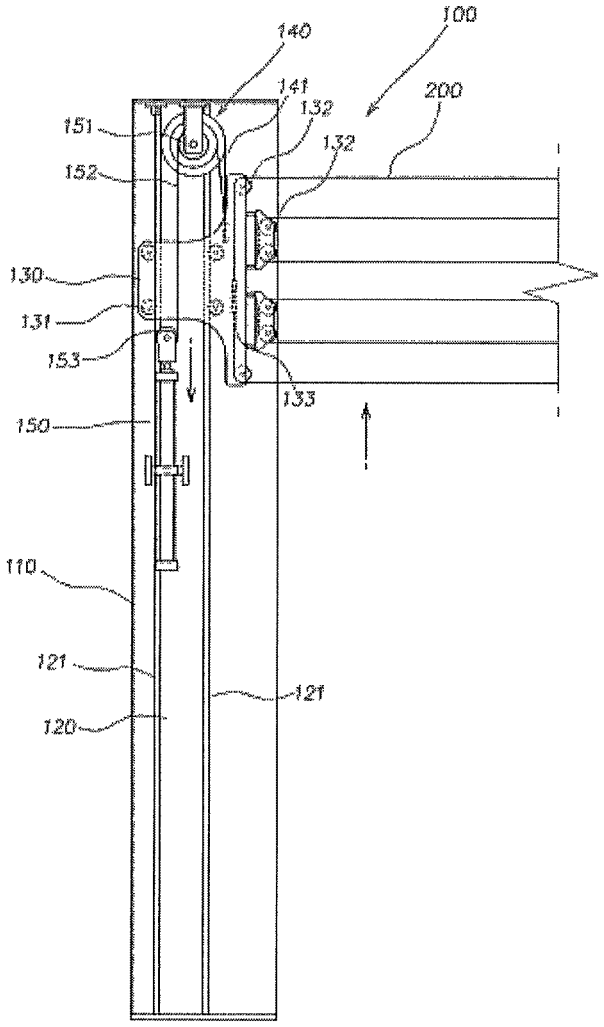

FIG. 2 is a front view illustrating the construction of a train platform safety device, according to the present invention. FIG. 3 is a plan view illustrating the construction of the train platform safety device, according to the present invention. FIGS. 4 through 6 are front views showing another embodiment of the train platform safety device according to the present invention. FIGS. 7 and 8 are front views illustrating the operation of the train platform safety device according to the present invention.

The train platform safety device according to the present invention includes: a plurality of wire rope lift units 100 which are installed at selected locations between an inlet of a platform through which a train enters the platform and an outlet of the platform and moves wire ropes 200 upwards or downwards; the wire ropes 200 which are oriented horizontally and connect the wire rope lift units 100 to each other; and a plurality of wire rope sagging prevention units 300 which are disposed at positions spaced apart from each other at predetermined intervals between the wire rope lift units 100 so as to prevent the wire ropes 200 from sagging and guide the wire ropes 200 so that the wire ropes 200 can smoothly move upwards or downwards.

Each wire rope lift unit 100 includes a body 110 which is vertically installed on the ground; a guide 120 which is vertically provided at a predetermined position in the body 110; a plurality of blocks 130 which are installed so as to be movable upwards or downwards along the guide 120 and provided with the wire ropes 200 connected to predetermined portions of the blocks 130 at positions spaced apart from each other at regular intervals in the vertical direction; a rotating unit 140 which is rotatably provided at a predetermined position on an upper end of the body 110 and has a plurality of rotating members which have different diameters and are respectively connected to the blocks 130, wherein the rotating members are rotated or reversely rotated at the same time so as to determine distances that the blocks 130 are moved upwards or downwards such that the wire ropes 200 overlap each other or spread from each other; a drive unit 150 which is installed at a predetermined position in the body 110 so as to rotate the rotating unit 140.

In the present invention, the wire rope lift unit 100 is disposed at a position corresponding to a safety line of a subway or railway platform behind which passengers are waiting for boarding a train. When the train reaches a boarding position, the wire rope lift unit 100 moves the wire ropes 200 upwards to allow the passengers who have waited on the platform to board the train. When the boarding is completed and the train departs from the platform, the wire rope lift unit 100 moves the wire ropes 200 downwards to ensure safety of passengers.

The body 110 is firmly fastened to the ground by an anchor bolt to minimize external shock or vibrations generated when the device is operated.

The guide 120 guides the blocks 130 so that the blocks 130 can smoothly move upwards or downwards.

In this embodiment, guide rails 121 are provided on opposite side surfaces of the guide 120 in the longitudinal direction of the guide 120. A plurality of guide rollers 131 are provided on a surface of each of the blocks 130 and make contact with the corresponding guide rail 121 and roll along the guide rail 121, whereby the block 130 can smoothly move upwards or downwards.

In lieu of a rotating means such as the guide rollers 131 which rotate along the guide rail 121, a linear movement member such as an LM block which slides along the guide rail 121 can be used.

In the present invention, the rotating unit 140 is a very important element which is rotated by operation of the drive unit 150 and thus determines the distances that the wire ropes 200 move upwards or downwards such that the wire ropes 200 overlap each other or spread from each other, whereby the wire ropes 200 allow or block access of passengers depending on conditions in which a train approaches or departs from the platform.

For this, the rotating unit 140 includes the rotating members which have different diameters and are connected to each other. In this case, when the rotating members are rotated by the operation of the drive unit 150, the rotational distances of the rotating members differ from each other depending on diameters, whereby the distances that the blocks 130 move upwards or downwards can be different from each other.

The diameters of the rotating members of the rotating unit 140 are preferably formed such that when the wire ropes 200 move upwards, the wire ropes 200 overlap each other, and when they move downwards, they spread from each other.

Of course, at least two or more blocks 130 and rotating members of the rotating unit 140 are provided such that the distances that the wire ropes 200 can be adjusted depending on conditions of a subway or railway platform.

Furthermore, a tapered gear, pulley or sprocket which is gradually increased or reduced in diameter may be used as the rotating unit 140.

Meanwhile, a connection means 141 is wound around each rotating members of the rotating unit 140 and is connected to a predetermined portion of the corresponding block 130. A belt, a rope or the like which has high flexibility is preferably used as the connection means 141 such that when the rotating unit 140 is rotated, it can be easily wound around or unwound from the rotating members.

The drive unit 150 is a means for rotating the rotating unit 140. In detail, the drive unit 150 includes: a cylinder which is installed at a predetermined position in the body 110; a drive pulley 151 which is connected to an end of the rotating unit 140; an interlocking pulley 153 which is rotatably provided on a rod of the cylinder; and a connector 152 which is fastened to a portion of the body 110, is provided around the interlocking pulley 153, and is connected to the drive pulley 151.

When the cylinder is extended or contracted, the connector 152 is moved. Then, the drive pulley 151 connected to the rotating unit 140 is rotated, whereby the blocks 130 and the wire ropes 200 can be moved upwards or downwards.

As shown in FIG. 5, the cylinder has rods on opposite ends thereof. The interlocking pulley 153 is provided on the rod disposed on a first end of the cylinder, and a weight unit 160 is provided on the rod disposed on a second end of the cylinder. This is to form a structure such that in the event of power failure or emergency, the weight unit 160 moves the rod of the cylinder downwards so that the blocks 130 and the wire ropes 200 can be moved upwards to allow passengers to safely evacuate.

The weight unit 160 is configured such that a plurality of weights are separably coupled to each other to enable a worker to selectively adjust the weight of the weight unit 160.

Preferably, a belt, a rope or the like which has high flexibility is used as a connector 152 such that it can be easily wound around or unwound from the drive pulley 151 by the operation of the drive unit 150 so as to adjust the positions to which the blocks 130 are moved upwards or downwards.

Meanwhile, as shown in FIG. 6, the cylinder may be configured such that rods are provided on opposite ends of the cylinder, the interlocking pulley 153 is provided on the rod disposed on a first end of the cylinder, and a connection member 171 is provided on the rod disposed on a second end of the cylinder. In this case, a lower end of the connection member 171 is connected to a rod of an auxiliary cylinder 170 which is installed on the bottom of the body 110. The auxiliary cylinder 170 contains compressed air of a predetermined pressure. If the cylinder malfunctions, the auxiliary cylinder 170 forcibly moves the rod disposed on the second end of the cylinder so as to move the blocks 130 and wire ropes 200, thus allowing passengers to safely evacuate.

The drive unit 150 includes: a drive motor 150*a* which is installed at a predetermined position in the body 110; a drive sprocket 151*a* which is connected to an end of the rotating unit 140; a rotating sprocket 152*a* which is provided on a rotating shaft of the drive motor 150*a*; and a chain 153*a* which connects the drive sprocket 151*a* to the rotating sprocket 152*a*.

Here, in lieu of the drive sprocket 151*a*, the rotating sprocket 152*a* or the chain 153*a*, gears, a belt or the like may be used, so long as it can be effectively used for transmission of rotating force.

In this embodiment, when the drive motor 150*a* is operated, the rotating force of the drive sprocket 151*a* and the rotating sprocket 152*a* is transmitted to the rotating unit 140, whereby the block 130 and the wire rope 200 can be moved upwards or downwards.

Meanwhile, each wire rope 200 is wrapped over the corresponding support rollers 132 which are provided on a surface of the corresponding block 130, and opposite ends of the wire rope 200 are connected to each other. Preferably, a tension adjustment spring 133 is provided on the junction between the opposite ends of the wire rope 200. By virtue of elastic restoring force of the tension adjustment spring 133, undesirable movement of the wire rope 200 can be minimized, and the tension thereof can be easily adjusted.

As shown in FIG. 7, when the rotating unit 140 is rotated in the normal direction by the operation of the drive unit 150, the blocks 130 and the wire ropes 200 are moved downwards by their own weights and spread out, thus blocking access of passengers.

In reverse, as shown in FIG. 8, when the rotating unit 140 is reversely rotated by the drive unit 150, the blocks 130 and the wire ropes 200 move upwards and overlap each other, thus allowing the access of passengers.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

The invention claimed is:

1. A train platform safety device, comprising: a plurality of wire rope lift units installed at selected locations between an inlet of a platform through which a train enters the platform and an outlet of the platform, the wire rope lift units moving wire ropes upwards or downwards; the wire ropes oriented horizontally, the wire ropes connecting the wire rope lift units to each other; and a plurality of wire rope sagging prevention units disposed at positions spaced apart from each other at predetermined intervals between the wire rope lift units so as to prevent the wire ropes from sagging and guide the wire ropes so that the wire ropes smoothly move upwards or downwards, wherein each of the wire rope lift units comprises: a body vertically installed on the ground; a guide vertically provided at a predetermined position of the body; a plurality of blocks installed so as to be movable upwards or downwards along the guide, with the wire ropes connected to predetermined portions of the blocks at positions spaced apart from each other at regular intervals in the vertical direction; a rotating unit rotatably provided at a predetermined position on an upper end or lower end of the body, the rotating unit comprising a plurality of rotating members having different diameters, the rotating members being respectively connected to the blocks, wherein the rotating members are rotated or reversely rotated at a same time so as to determine distances that the blocks are moved upwards or downwards such that the wire ropes overlap each other or spread from each other; and a drive unit installed at a predetermined position in the body, the driving unit rotating the rotating unit.

2. The train platform safety device of claim 1, wherein guide rails are provided on opposite side surfaces of the guide in a longitudinal direction of the guide, and a plurality of guide rollers are provided on a surface of each of the blocks, the guide rollers making contact with the corresponding guide rails and rolling along the guide rails.

3. The train platform safety device of claim 1, wherein a connection means is wound around each rotating member of the rotating unit and connected to a predetermined portion of the corresponding block.

4. The train platform safety device of claim 1, wherein the drive unit comprises:

a cylinder installed at a predetermined position in the body;

a drive pulley connected to an end of the rotating unit;

an interlocking pulley rotatably provided on a rod of the cylinder; and a connector fastened to a portion of the body, the connector being provided around the interlocking pulley and connected to the drive pulley.

5. The train platform safety device of claim 4, wherein the cylinder has rods on first and second ends thereof, the interlocking pulley is provided on the rod disposed on the first end of the cylinder, and a weight unit is provided on the rod disposed on the second end of the cylinder.

6. The train platform safety device of claim 4, wherein the cylinder has rods on first and second ends thereof, the interlocking pulley is provided on the rod disposed on the first end of the cylinder, and a connection member is provided on the rod disposed on the second end of the cylinder, the connection member being connected at a lower end thereof to a rod of an auxiliary cylinder installed on a bottom of the body.

7. The train platform safety device of claim 1, wherein the drive unit comprises:

a drive motor installed at a predetermined position in the body;

a drive sprocket connected to an end of the rotating unit;

a rotating sprocket provided on a rotating shaft of the drive motor; and a chain connecting the drive sprocket to the rotating sprocket.

8. The train platform safety device of claim 1, wherein a plurality of support rollers are provided on a surface of each of the blocks, each of the wire ropes is wrapped over the corresponding support rollers, opposite ends of the wire rope are connected to each other, and a tension adjustment spring is provided on a junction between the opposite ends of the wire rope.

* * * * *